US006144015A

United States Patent [19]

Chiu et al.

[11] Patent Number: 6,144,015

[45] Date of Patent: Nov. 7, 2000

[54] GLOW SENSOR—CERAMIC FLAT PLATE

[75] Inventors: Randolph Kwok-Kin Chiu, Davison; David Kwo-Shyong Chen, Rochester Hills, both of Mich.

[73] Assignee: General Motors Corporation, Detroit, Mich.

[21] Appl. No.: 09/160,397

[22] Filed: Sep. 25, 1998

[51] Int. Cl.[7] ..... F23Q 7/22

[52] U.S. Cl. ..... 219/270; 123/145 A; 123/145 R

[58] Field of Search ..... 219/205, 260, 219/262, 263, 264, 265, 266, 267, 268, 269, 270, 523, 541, 543, 544, 546, 548, 553; 123/145 A, 145 R, 143 R; 338/226; 361/266; 324/459, 464, 465

[56] References Cited

U.S. PATENT DOCUMENTS

| | | | |
|---|---|---|---|
| 4,545,339 | 10/1985 | Brooks et al. | 123/145 A |
| 4,733,056 | 3/1988 | Kojima et al. | 219/543 |
| 4,739,731 | 4/1988 | Habich et al. | 123/494 |
| 4,810,853 | 3/1989 | Maruta et al. | 219/270 |
| 4,912,305 | 3/1990 | Tatemasu et al. | 219/544 |
| 5,084,607 | 1/1992 | Shafer et al. | 219/270 |
| 5,264,681 | 11/1993 | Nozaki et al. | 219/544 |
| 5,589,091 | 12/1996 | Muller | 219/270 |
| 5,645,742 | 7/1997 | Schmidt et al. | 219/270 |
| 5,783,801 | 7/1998 | Riti et al. | 219/270 |
| 5,811,761 | 9/1998 | Kita et al. | 219/270 |
| 5,834,736 | 11/1998 | Kawamura | 219/270 |
| 5,852,280 | 12/1998 | Mizuno | 219/270 |
| 5,880,432 | 3/1999 | Radmacher | 219/270 |
| 5,883,360 | 3/1999 | Tatematsu et al. | 219/270 |
| 5,922,229 | 7/1999 | Kurano | 219/270 |
| 5,998,765 | 12/1999 | Mizuno et al. | 219/270 |

FOREIGN PATENT DOCUMENTS

| | | |
|---|---|---|
| 19737396A1 | 3/1998 | Germany . |
| 19738915A1 | 3/1998 | Germany . |
| WO97/38223 | 10/1997 | WIPO . |

*Primary Examiner*—Teresa Walberg
*Assistant Examiner*—Fadi H. Dahbour
*Attorney, Agent, or Firm*—Vincent A. Cichosz

[57] ABSTRACT

A glow sensor provides functions of both a diesel engine glow plug and an ion sensor for sensing engine combustion initiation and characteristics. A ceramic flat plate glow sensor element is carried by a tubular ceramic sleeve and insulating material in a metal shell. The element includes a ceramic flat plate having a glow tip, on an inner end with a heating element on one side and an ion sensor electrode on the other printed in electrically conductive ink. Printed conductors on both sides connect the heating element and ion sensor with an outer end of the glow sensor element for connection with an electric power source. An insulating coating protects the heating element and conductors from exposure to combustion gases. Various flat plate mounting embodiments are disclosed.

9 Claims, 5 Drawing Sheets

FIG 4
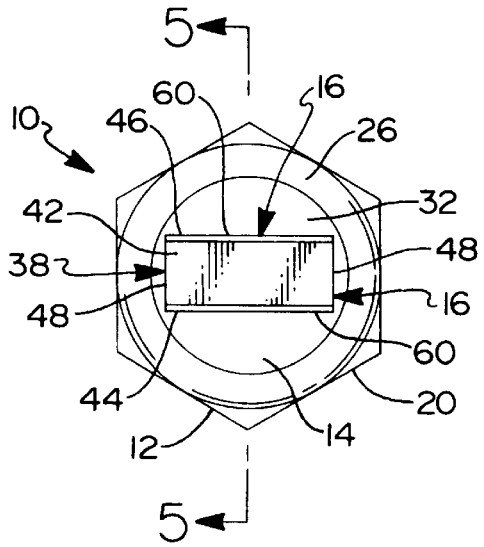
FIG 9
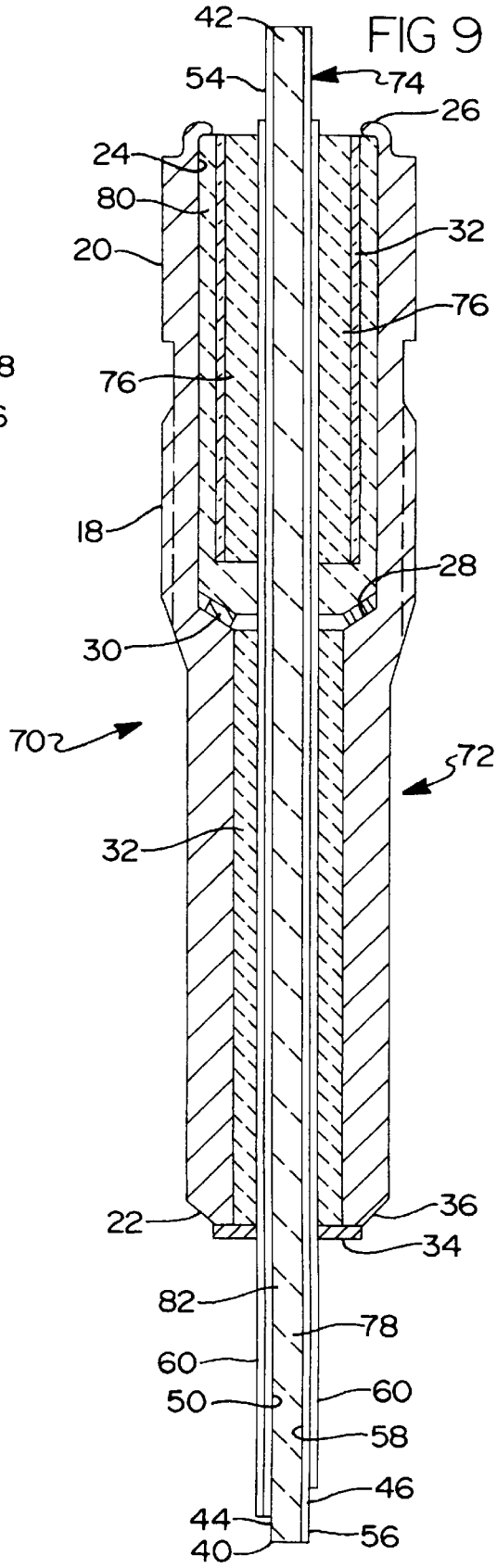
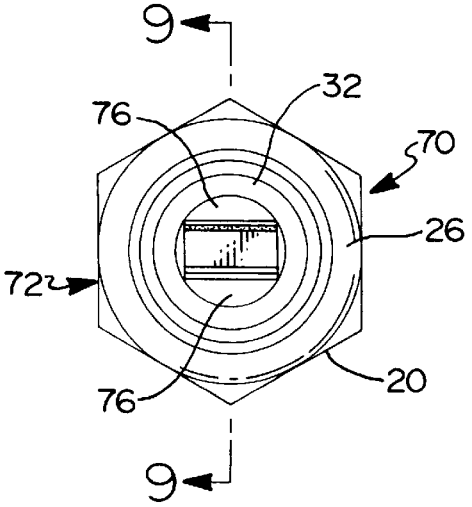
FIG 8

GLOW SENSOR— CERAMIC FLAT PLATE

TECHNICAL FIELD

This invention relates to diesel engines and, more particularly, to glow sensors which combine functions of both a glow plug and an ion sensor to promote fuel ignition in an engine combustion chamber during starting and low temperature running and to sense the occurrence and character of combustion events.

BACKGROUND OF THE INVENTION

It is known in the art relating to diesel engines to provide an ignition glow plug having a heated glow tip which extends into the engine combustion chamber or pre-chamber to promote ignition of fuel, especially during starting and low temperature operation. It is also known in internal combustion engines to provide an ion sensor in the combustion chamber which senses the occurrence of combustion events through variations in current flow across a gap through combustion gases in the chamber. The combination of a ceramic glow plug tip combined with an ion sensor for use in a diesel engine has also been proposed.

SUMMARY OF THE INVENTION

The present invention provides unique and specific embodiments of diesel engine glow sensors intended for use in diesel engines and combining the functions of both glow plugs and ion sensors. In particular, this invention provides various embodiments of glow sensors, each having a ceramic flat plate glow sensor element with an electric heating element and conductors printed on one side of a ceramic flat plate and an ion sensor electrode and conductor printed on an opposite side of the flat plate. Various means for supporting and insulating the glow sensor element in a metal shell are provided. For convenience, the term "glow sensor" is used herein to refer to devices, such as those described herein, for carrying out functions of both a glow plug and an ion sensor.

In general, a device according to the invention may be defined as a glow sensor for use in a combustion chamber of a diesel engine: the glow sensor having a tubular metal shell including mounting means for mounting the glow sensor in a chamber defining component of the engine; a tubular ceramic support sleeve carried in the shell; a ceramic flat plate glow sensor element carried by the support sleeve and having an outer end terminating adjacent an outer end of the shell and isolated therefrom by the sleeve, and an inner end including a glow tip extending inwardly beyond inner ends of the shell and the sleeve; and insulating material within the support sleeve and within the metal shell and supporting the glow sensor element in the shell; the glow sensor element including: a ceramic flat plate extending between the inner and outer ends of the glow sensor element and having opposite first and second sides and adjacent lateral edges; an electric heating element and first and second conductors printed on the first side of the flat plate, the heating element disposed at the location of the glow tip and the conductors extending from the heating element to the outer end of the glow sensor element; an ion sensor electrode and a third conductor printed on the second side of the of the flat plate, the electrode disposed adjacent the inner end of the flat plate and the third conductor extending from the electrode to the outer end of the flat plate; and an insulating coating on both sides of the flat plate and covering the printed conductors and the heating element for protection from combustion gases.

These and other features and advantages of the invention will be more fully understood from the following description of certain specific embodiments of the invention taken together with the accompanying drawings.

BRIEF DESCRIPTION OF THE DRAWINGS

In the drawings:

FIG. 4 is an outer end view of the embodiment of FIG. 3;

FIG. 8 is an outer end view of the embodiment of FIG. 7;

FIG. 9 is a transverse cross-sectional view from the line 9—9 of FIG. 8;

DESCRIPTION OF THE PRIOR ART

Figure 1:
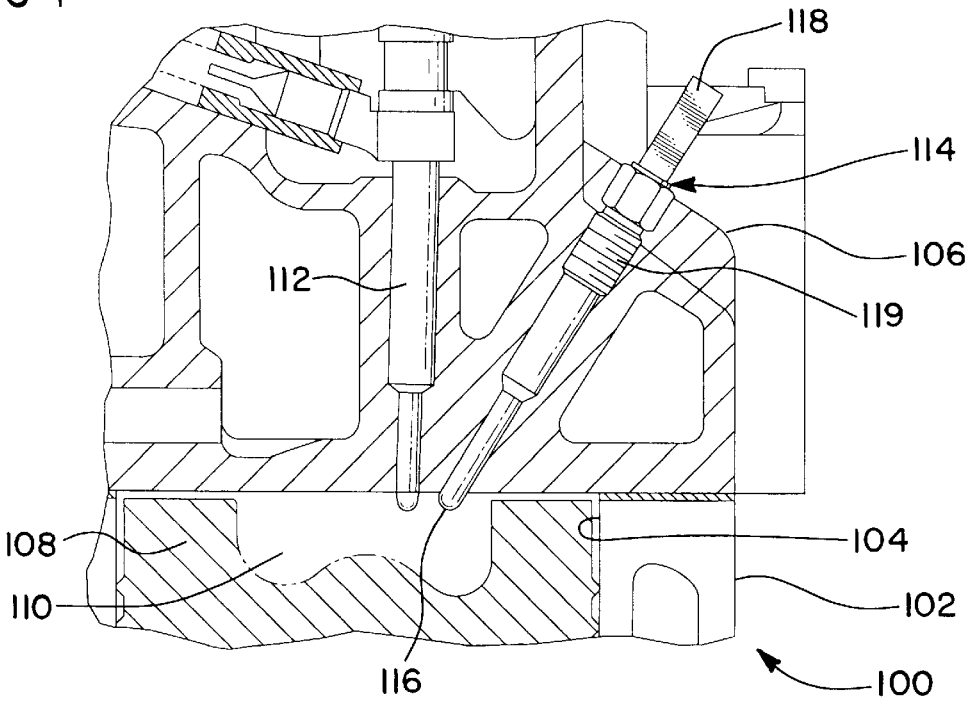
PRIOR ART FIG 1
FIG. 1 is a fragmentary cross-sectional view of an open chamber diesel engine having direct injection of fuel into the combustion chamber and a prior art glow plug with a glow tip extending into the combustion chamber.
Figure 2:
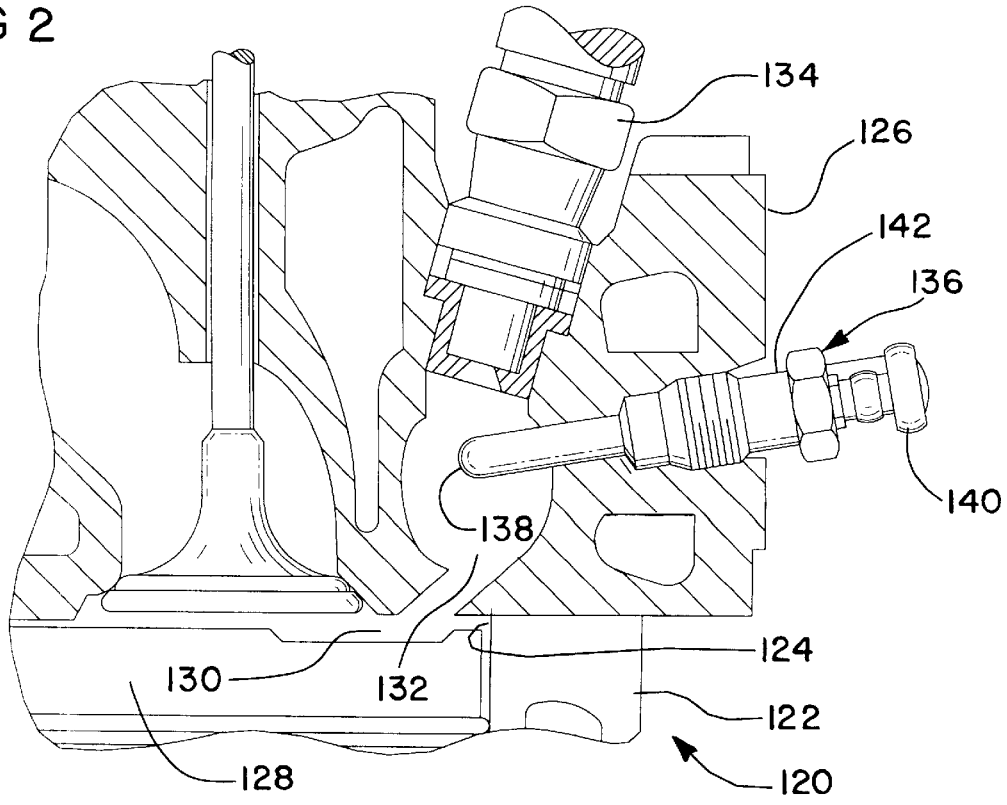
PRIOR ART FIG 2
FIG. 2 is a fragmentary cross-sectional view of a pre-chamber type diesel engine having indirect fuel injection into the pre-chamber and a prior art glow plug with a glow tip extending into the pre-chamber.

Referring first to FIGS. 1 and 2 of the drawings in detail, there are shown examples of prior art applications of diesel engine glow plugs to both open chamber and pre-chamber type diesel engines. These applications utilize glow plugs of a common type having a glow tip formed within a metal sheath. However, the use of other forms of glow tips in place of the metal sheath type glow plugs is also known.

In FIG. 1, numeral 100 generally indicates an open chamber type diesel engine having a cylinder block 102 defining a cylinder 104 closed by a cylinder head 106. A piston 108 is reciprocable in the cylinder 104 and defines a recessed bowl which, together with the cylinder head, forms a combustion chamber 110. The cylinder head 106 mounts an injection nozzle or injector 112 which sprays fuel into the combustion chamber 110 for compression ignition therein. The cylinder head also mounts a known form of glow plug 114 having a glow tip 116 extending into the combustion chamber. The glow tip is heated during cold engine starting and low temperature operation to assist in igniting fuel sprayed into the combustion chamber during periods when the temperature of compression may be insufficient to provide for proper fuel ignition and combustion.

The illustrated glow plug 114 is of the type having a metallic sheath forming the glow tip. A terminal 118 is provided at the outer end of the glow plug for connection with a source of electric current. Return current flow is from the metal sheath of the glow tip to a metal shell 119 of the glow plug and to the cylinder head in which the shell is mounted and which is grounded to the electrical system.

Referring to FIG. 2, numeral 120 indicates a pre-chamber type diesel engine having a cylinder block 122 with a cylinder 124 closed by a cylinder head 126 and carrying a piston 128 reciprocable in the cylinder. The piston and cylinder head form a combustion chamber 130 which connects with a pre-combustion chamber or pre-chamber 132 within the cylinder head. A fuel injector 134 is mounted in the cylinder head for injecting fuel into the pre-chamber 132. A glow plug 136 of known form has a glow tip 138 extending into the pre-chamber to assist in igniting the fuel during starting and cold operation. A terminal 140 at the other end of the glow plug provides for connection to a source of electric current and the glow plug shell 142 is grounded to the cylinder head for completing the return current flow path as in the first described embodiment.

DESCRIPTION OF THE PREFERRED EMBODIMENTS

The present invention provides novel glow sensors which may be installed in the glow plug openings of diesel engines of the types previously described. These glow sensors provide both the prior glow plug function of assisting in the ignition of the fuel during cold starting and operation and the additional ion sensor function of sensing the occurrence and character of the combustion event in the combustion chamber or pre-chamber through variations in ionization of combustion gases within the chamber during combustion in accordance with and for purposes that are known in the art. The terms "inner end" and "outer end" as used in the subsequent description and claims refer to directions in the glow sensor as installed in an engine wherein the glow tip forms an inner end extending within a combustion chamber (including a pre-chamber) and electrical terminals are located at an outer end extending outside the engine cylinder head.

Figure 3:
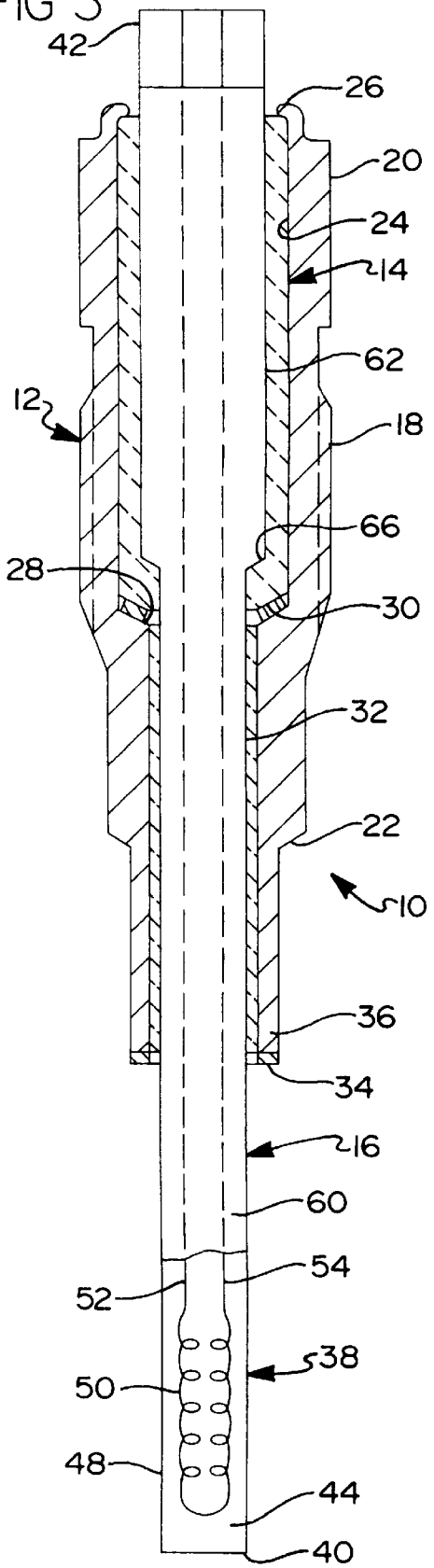
FIG. 3 is a transverse cross-sectional view of a first embodiment of glow sensor formed according to the invention.
Figure 5:
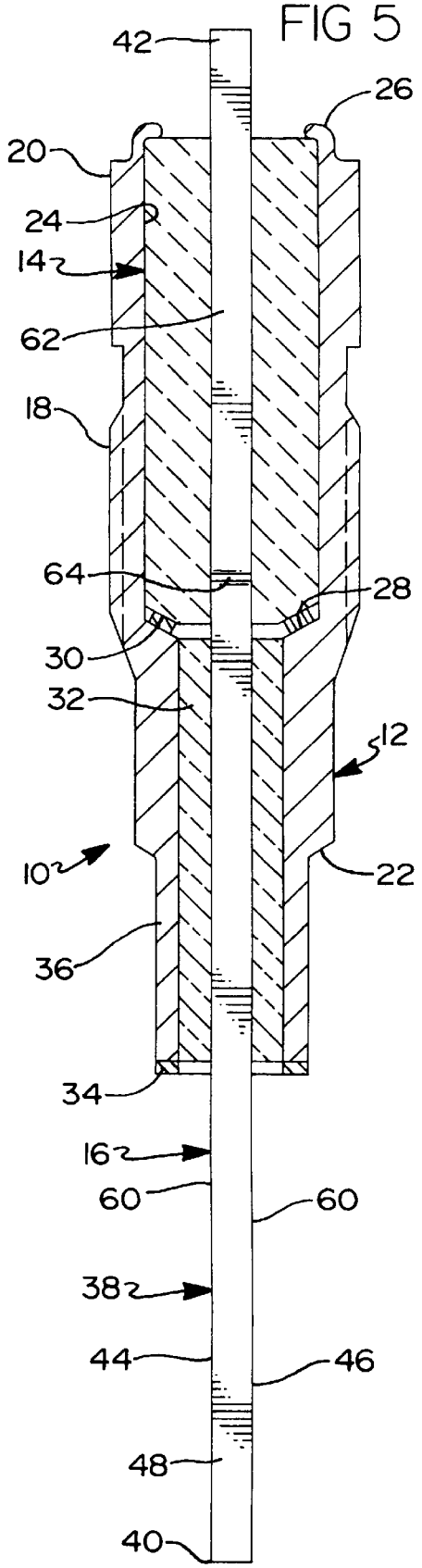
FIG. 5 is a transverse cross-sectional view from the line 5—5 of FIG. 4.

Referring now to FIG. 3 of the drawings, numeral 10 generally indicates a first embodiment of glow sensor formed in accordance with the invention. Glow sensor 10 combines the functions of an ignition glow plug and a combustion chamber ion sensor in a single device having the general appearance of a glow plug and able to be installed in an engine in the cylinder head opening commonly provided for a glow plug. In particular, glow sensor 10, as shown, has a general configuration similar to that of the prior art glow plug 136 shown in FIG. 2; however, the internal features and glow sensor element could equally well be used in glow sensors configured similarly to prior art glow plug 114 shown in FIG. 1.

Glow sensor 10 is constructed with a tubular metal shell 12 having a hollow interior, into one end of which is inserted a tubular ceramic sleeve 14 that in turn carries a ceramic flat plate glow sensor element 16.

The metal shell 12 may be made of steel and includes external threads 18 and a hexagonal end 20 for threading the glow sensor into a conventional glow plug opening in the cylinder head of a diesel engine. A conical shoulder 22 may be provided for seating the metal shell against a seat in the engine glow plug opening. The shell 12 is generally tubular and includes a counterbore 24 opening through an outer end 26 of the shell and terminating internally in a conical seat 28 against which a sealing gasket 30, such as a copper washer or the like, is seated.

The ceramic sleeve 14 is received within counterbore 24 and has a conical end that engages the sealing gasket 30. The outer end 26 of the shell is crimped over to retain the ceramic sleeve 14 in place and exert an axial force thereon which compresses the sealing gasket 30 to provide a combustion seal at the interface.

The flat plate glow sensor element 16 is supported within the ceramic sleeve 14 and extends through the metal shell 12. Clearances between the element 16 and the sleeve 14 and between the element 16 and the shell 12 are filled with electrical insulation 32 in the form of a glass or ceramic powder or cement seal which provides in addition structural support for the ceramic element 16 to prevent failure due to vibration of the element within the shell and sleeve. A metallic washer 34 is welded to an inner end 36 of the shell to retain the electrical insulation surrounding the element 16 within the shell 12.

The glow sensor element 16 is made up of a ceramic flat plate 38 extending between inner and outer ends 40, 42 respectively of the glow sensor element and having first and second opposite sides 44, 46 respectively and adjacent lateral edges 48.

On the first side 44 of the plate, an electric heating element 50 is formed. Element 50 connects with first and second conductors 52, 54, respectively, extending from the ends of the heating element to the outer end 42 of the flat plate 38. The heating element 50 is located on the flat plate near its inner end 40 and forms a glow tip at the inner end of the glow sensor element. The heating element 50 and the conductors 52, 54 connected with it are preferably formed of platinum (Pt) or palladium (Pd) applied as ink by printing on the first side 44 of the flat plate 38.

Figure 6:
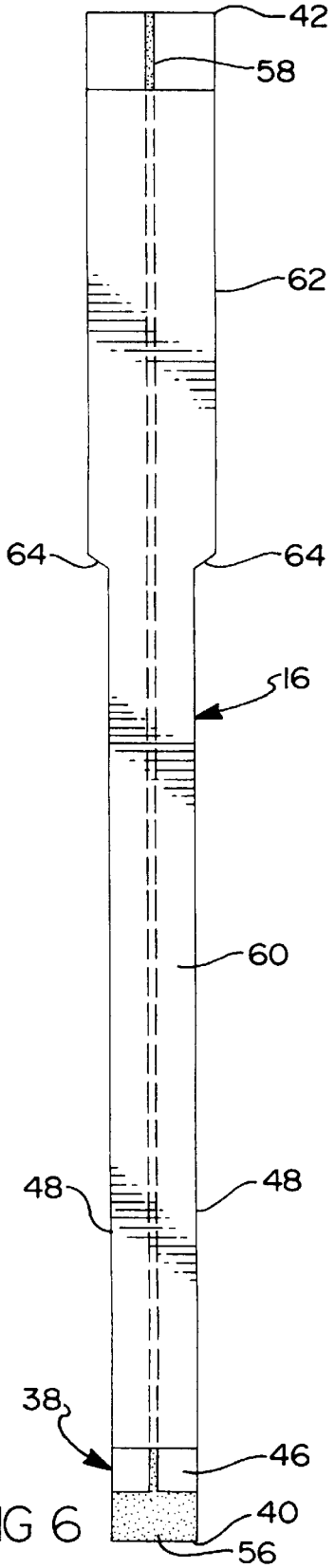
FIG. 6 is a rear side view of the glow sensor element in the embodiment of FIG. 3.
Figure 7:
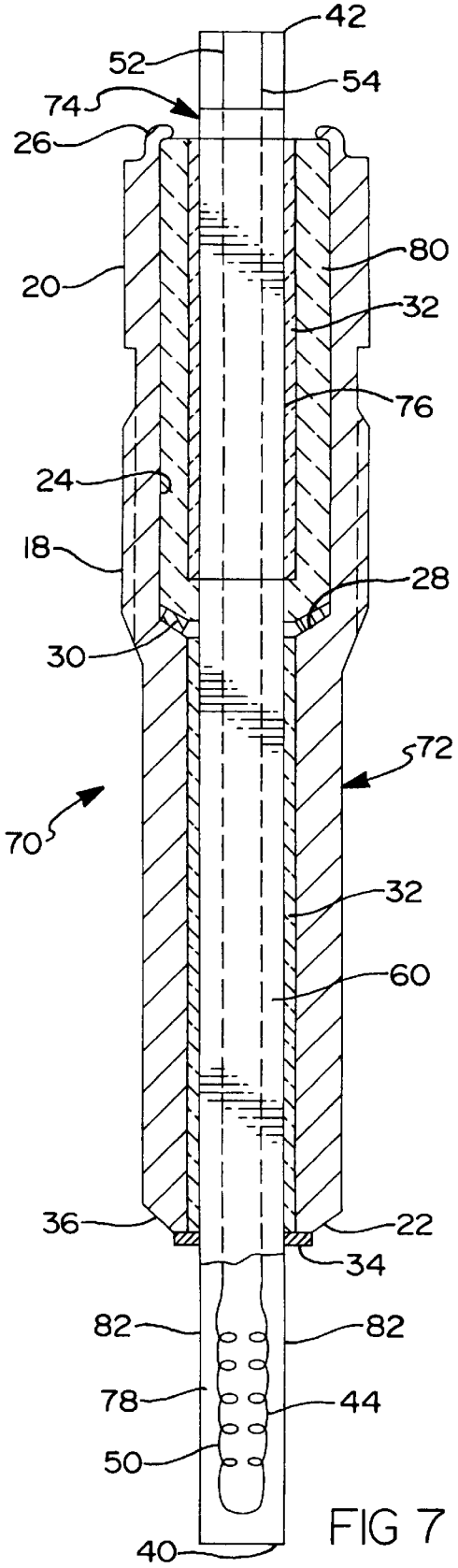
FIG. 7 is a transverse cross-sectional view of a second embodiment of glow sensor according to the invention.
Figure 10:
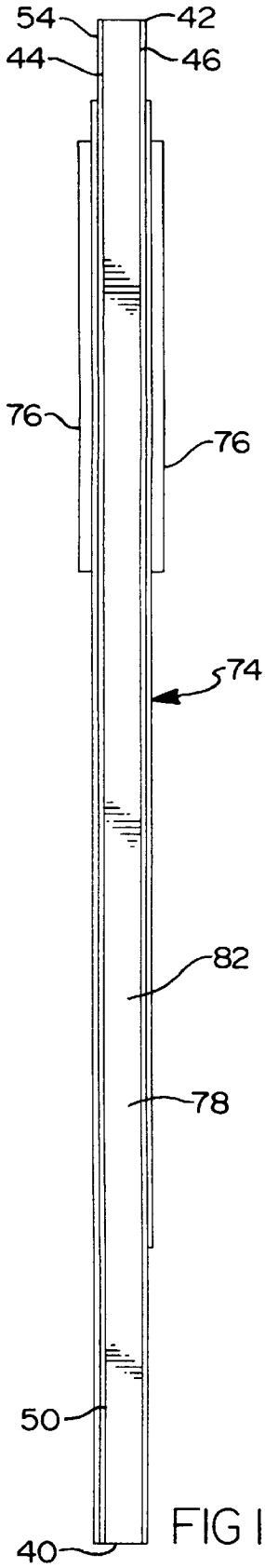
FIG. 10 is an edge view of the glow sensor in the embodiment of FIG. 7.
Figure 11:
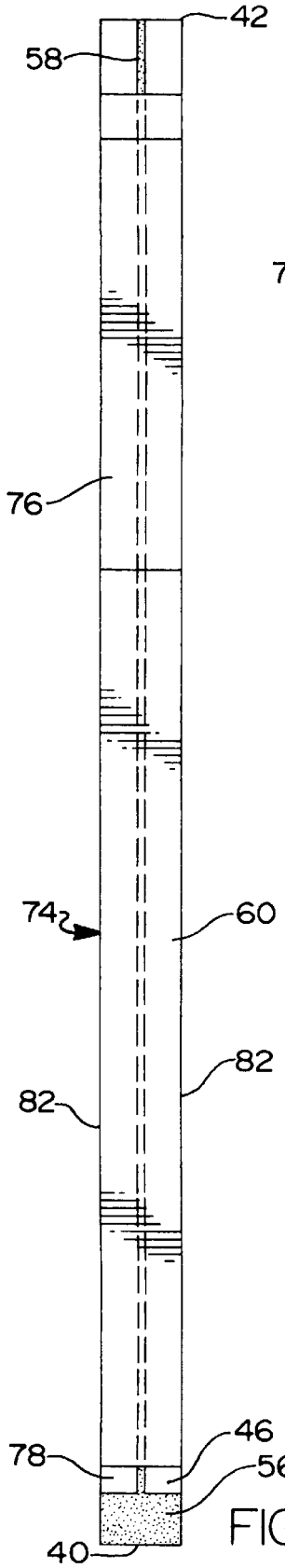
FIG. 11 is a rear side view of the glow sensor in the embodiment of FIG. 7.
Figure 12:
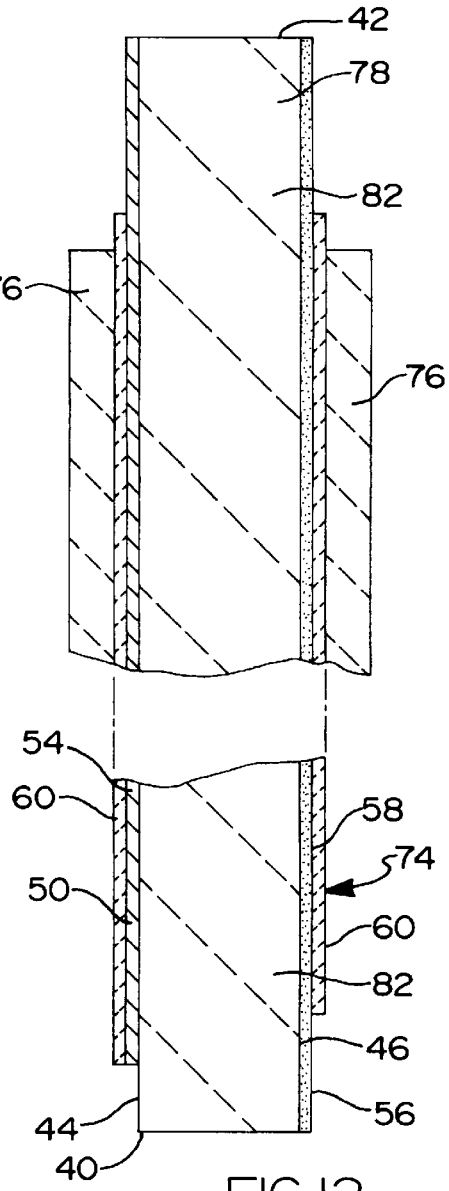
FIG. 12 is an enlarged cross-sectional view of portions of FIG. 10.

In a similar fashion, a conductive ink such as platinum or palladium is applied on the second side 46 of the flat plate as shown in FIG. 6. The conductive ink is printed adjacent the outer end 40 of the flat plate, forming an exposed ion sensor electrode 56 which is connected by a single conductor 58 with the opposite outer end 42 of the flat plate 38. On both sides of the flat plate 38, a protective coating of ceramic 60 is applied which covers the heating element and its conductors and the conductor for the ion sensor electrode 56 to protect them from exposure and corrosion by combustion gases. However, the ion sensor electrode 56 is left exposed, as is necessary for its operation and the conductors 52, 54, 58 are exposed at the outer end of the flat plate for connection to separate terminals not shown.

The features of glow sensor 10 so far described are in general common with those of the second embodiment to be subsequently described. Accordingly like numerals are utilized for like parts. Sensor 10 is unique, however, in the manner in which the glow sensor element is constructed to provide for its retention within the sleeve 14 and shell 12.

In glow sensor 10, the ceramic flat plate 38 and the resulting glow sensor element 16 are maintained with a generally constant thickness over the entire length of the element. Thus to retain the element within the shell, the flat plate is provided with lateral edges including an outwardly stepped portion 62 adjacent the outer end 42 of the glow sensor element 16. The stepped portion includes angled abutments 64 which engage an internal annular seat 66 formed within the ceramic sleeve 14 and preventing the glow sensor element 16 from moving further inward within the sleeve 14 and the associated metallic shell 12. The ceramic or glass electrical insulation 32 surrounding the glow sensor element 16, when it is installed within the sleeve and shell, prevents its being withdrawn from these assembled elements, as does the crimping of the outer end 26 of the shell against the sleeve.

Referring now to FIGS. 7–12, there is shown a second embodiment of glow sensor generally indicated by numeral 70. Sensor 70 is similar in large part to the first described embodiment of glow sensor 10 so that like numerals are used for like parts. The construction of glow sensor 70 differs in one respect in that the shell 72 and glow sensor element 74 are made longer for installation of the assembly into a direct injection diesel engine as shown in FIG. 1. However these elements could be formed with a length similar to those of glow sensor 10 for installation within an indirect injection engine as shown in FIG. 2.

A significant difference in the construction of the second embodiment of glow sensor 70 is that the glow sensor element 74 is modified by the addition of ceramic shoulders or plates 76 laminated onto the first and second sides of the ceramic flat plate 78 and over the ceramic coating 60 which protects the conductors printed on the first and second sides 44, 46 of the plate. These shoulders 76 are received within a recess within the ceramic sleeve 80 and function to retain the glow sensor element 74 from movement further inward from its fixed position within the shell 72. This construction allows the flat plate to be simplified by eliminating the stepped portion and providing lateral edges 82 which are linear and can thus be cut from a flat sheet with a single straight cut thereby making manufacture of flat plates for the glow sensor elements more efficient and less costly.

As in the first described embodiment, ceramic or glass electrical insulation powder or cement 32 is filled into clearances between the glow sensor element 74 and the surrounding sleeve 80 and metallic shell 72 to retain the glow sensor element fixed within the shell. In other ways the construction of glow sensor element 70 is essentially the same as that of glow sensor 10. As used in the claims, the term "combustion chamber" is intended to include a pre-chamber or precombustion chamber within its scope.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A glow sensor for use in a combustion chamber of a diesel engine, said glow sensor comprising:

a tubular metal shell including mounting means for mounting the glow sensor in a chamber defining component of the engine, the shell having a passageway extending axially therethrough;

a tubular ceramic support sleeve carried in the passageway of the shell;

a ceramic flat plate glow sensor clement carried by the support sleeve and having an outer end terminating adjacent an outer end of the shell and isolated therefrom by the sleeve, and extending through the passageway to an inner end including a glow tip extending inwardly beyond inner ends of the shell and the sleeve; and insulating material within the support sleeve and within the metal shell and supporting the glow sensor element in the shell;

said glow sensor element including:

a single ceramic flat plate extending between said inner and outer ends of the glow sensor element and having opposite first and second sides and adjacent lateral edges;

an electric heating element and conductors printed on said first side of the flat plate, said heating element disposed at the location of the glow tip and said conductors extending from the heating element to the outer end of the glow sensor element;

an ion sensor electrode and a conductor printed on said second side of the of the flat plate, said electrode disposed adjacent an inner end of the flat plate and said conductor extending from the electrode to an outer end of the flat plate; and an insulating coating on both sides of the flat plate and covering the printed conductors and the heating element for protection from combustion gases.

2. A glow sensor as in claim 1 wherein said ceramic support sleeve is cylindrical and is received in an axial counterbore adjacent the outer end of the metal shell, said counterbore having an internal annular end;

the glow sensor has an annular sealing gasket seated on the annular end; and the support sleeve inner end engages the sealing gasket to provide a combustion gas seal; the sleeve being retained in the counterbore by retaining means applying an axial force urging the sleeve against the sealing gasket.

3. A glow sensor as in claim 2 wherein said retaining means comprises a crimped edge portion at the outer end of the metal shell.

4. A glow sensor as in claim 1 and including a washer fixed on the inner end of the metal shell and retaining said insulating material within the metal shell.

5. A glow sensor as in claim 1 wherein said insulating material is selected from the group consisting of glass and ceramic.

6. A glow sensor as in claim 1 wherein said lateral edges of the flat plate include an outwardly stepped portion within the support sleeve and near the outer end of the flat plate, the stepped portion engaging an internal shoulder of the support sleeve for locating the glow sensor element within the metal shell.

7. A glow sensor as in claim 1 wherein said lateral edges of the flat plate are linear and said glow sensor element further includes shoulder members laminated on opposite sides of the element, the shoulder members engaging an internal shoulder of the support sleeve for locating the glow sensor element within the metal shell.

8. A glow sensor as in claim 7 wherein said shoulder members are formed of a ceramic material.

9. A glow sensor as in claim 1 wherein said electric heating element, electrode and conductors printed on the first and second sides of the flat plate are formed of material selected from the group consisting of platinum and palladium.

* * * * *